US005162629A

United States Patent [19]

Erz et al.

[11] Patent Number: 5,162,629

[45] Date of Patent: Nov. 10, 1992

[54] RADIO-FREQUENCY VENEER DRYER

[75] Inventors: Joseph M. Erz, Jefferson; Bruce G. Miller; Craig A. Gribskov, both of Bend, all of Oreg.

[73] Assignee: Production Machinery, Inc., Bend, Oreg.

[21] Appl. No.: 643,039

[22] Filed: Jan. 18, 1991

[51] Int. Cl.[5] ..... H05B 6/60

[52] U.S. Cl. ..... 219/10.81; 34/1 J; 34/1 L

[58] Field of Search ..... 219/10.81, 10.61 R, 219/10.75, 10.69; 34/1 E, 1 F, 1 G, 1 H, 1 J, 1 K, 1 L, 1 M, 1 N, 9.5

[56] References Cited

U.S. PATENT DOCUMENTS

| | | | |
|---|---|---|---|
| 2,567,983 | 9/1951 | Wood | 34/1 L |
| 3,096,161 | 7/1963 | Morrison et al. | 34/1 L |
| 3,507,050 | 11/1967 | Smith et al. | 219/10.55 |
| 3,622,733 | 11/1971 | Smith et al. | 219/10.69 |
| 3,701,875 | 10/1972 | Witsey et al. | 219/10.81 |
| 3,722,105 | 3/1973 | Marteny | 34/1 J |
| 3,744,147 | 7/1973 | Pless | 34/1 |
| 3,761,670 | 9/1973 | Slaats et al. | 219/10.61 |
| 3,866,255 | 2/1975 | Serota | 34/1 K |
| 4,148,346 | 4/1979 | Scarnecchia | 219/10.81 |
| 4,258,240 | 3/1981 | Pless | 219/10.81 |
| 5,074,055 | 12/1991 | Peraniitty et al. | 34/1 E |

*Primary Examiner*—Philip H. Leung
*Attorney, Agent, or Firm*—Kolisch, Hartwell, Dickinson, McCormack & Heuser

[57] ABSTRACT

A continuous radio frequency dryer that includes a dryer housing and a conveyor extending through the housing. The conveyor is made up of a series of conveyor rolls spaced from each other, and a pressure roll is above and parallel to each conveyor roll. Plural sets of electrodes alternate with the conveyor rolls, and the electrodes are supplied radio frequency energy. Air is circulated through the housing.

8 Claims, 2 Drawing Sheets

RADIO-FREQUENCY VENEER DRYER

BACKGROUND AND SUMMARY OF THE INVENTION

This invention relates to veneer dryers and, more particularly, to a veneer dryer which utilizes radio frequency augmented with moderately hot, circulated air, to produce a faster drying time and more consistent uniform results than possible with known dryers.

Continuous veneer dryers, as presently known, ordinarily rely on circulated hot air to remove moisture from the wood and produce the drying action. Problems have been encountered in the use of conventional dryers. For instance, to obtain proper drying, many dryers require a large amount of floor space, which is undesirable. With the hot temperatures used for the air, scorching of the wood may occur. Volatiles which are released at higher temperatures are a problem. Dryer results are inconsistent, and highly dependant on the species and structure of the particular wood handled, and its moisture content.

This invention is based on the finding that very superior drying results are obtainable in a continuous veneer dryer, where radio frequency is relied upon to drive moisture carried internally in the wood to surfaces of the wood. With the moisture on the surface, the moisture is evaporated and removed by a stream of air which may be heated only to a moderate temperature. For instance, a temperature within the range of 250 to 350 degrees F. has been found highly satisfactory. Because of the use of radio-frequency energy, drying results are far less dependent on wood species, structure, and initial moisture conditions The use of only moderately heated air eliminates any tendency for scorching to occur. Further, over-drying is not a problem, and organic materials that volatilize at high temperature are not released. Dryer efficiencies are such that for a given volume of veneer, markedly less floor space for a dryer is required than is required for conventional type dryers.

Accordingly, an object of the invention is to provide an improved continuous veneer dryer, which utilizes radio frequency to liberate internal moisture and transport such to the veneer surfaces, with drying then being aided by the circulation of air at moderate temperature.

Another object is to provide a dryer which includes aluminum-surfaced conveyor and pressure-applying rolls for transmitting veneer through the dryer. By the use of aluminum, staining of the wood handled is minimized. With the presence of the pressure rolls, the veneer material is, in effect, subjected to an ironing action. Drying takes place with reduction of curling and deformation of the veneer.

A further object is to provide such a continuous veneer dryer, wherein radio-frequency electrodes utilized to subject the veneer material to radio-frequency energy take the form of aluminum electrodes distributed along the length of the dryer and interspersed with the conveyor rolls.

These and other objects and advantages are attained by the invention, which is described hereinbelow in conjunction with the accompanying drawings.

DETAILED DESCRIPTION OF THE PREFERRED EMBODIMENT

Figure 2:
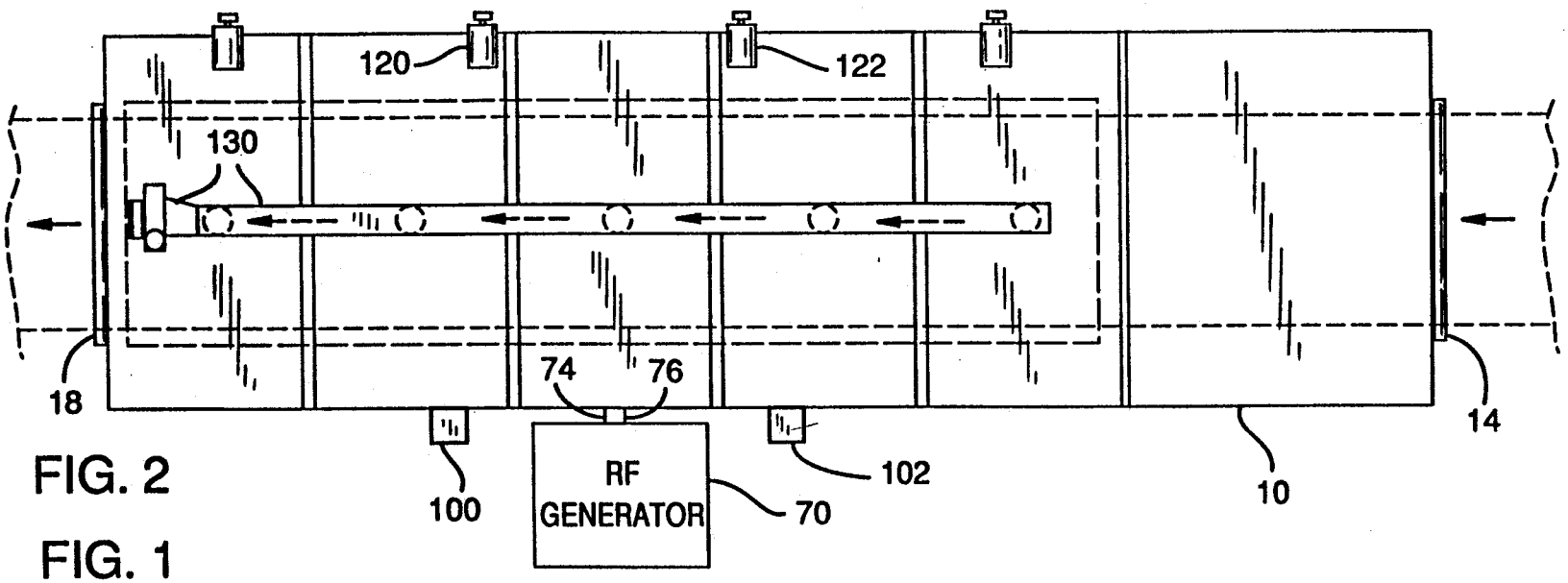
FIG. 2 is a simplified, partially diagrammatic plan view of the dryer.
Figure 1:
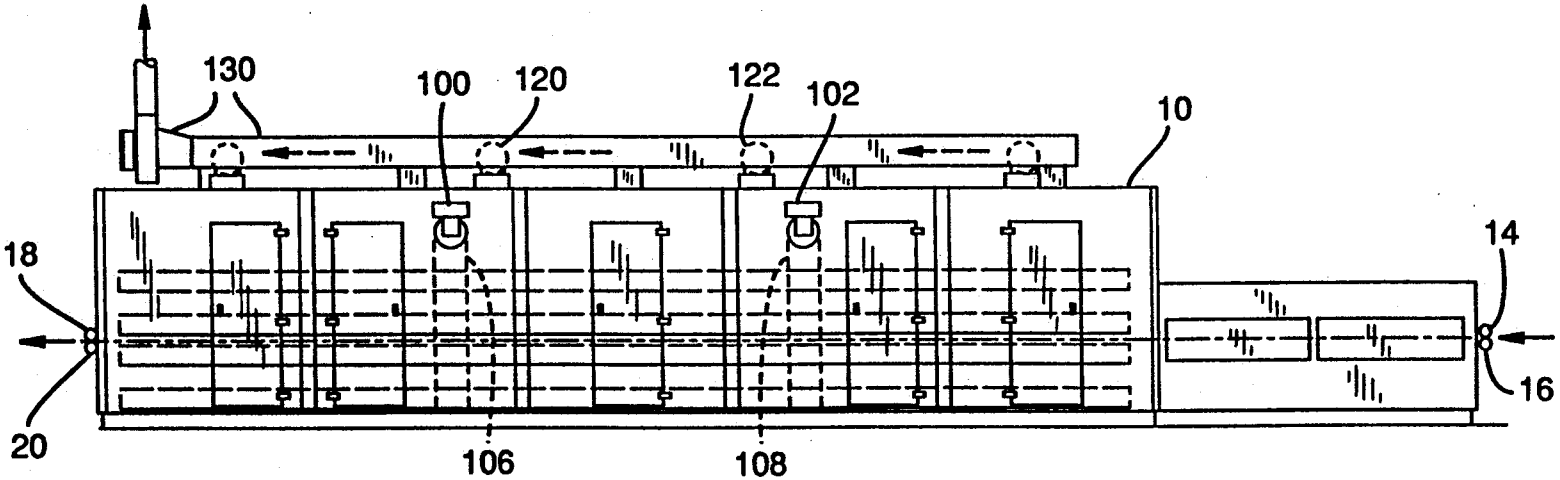
FIG. 1 is a simplified, partially diagrammatic, side elevation of a dryer according to the invention.

Referring to the drawings, the dryer illustrated includes an elongate dryer housing illustrated at 10. Veneer enters the dryer housing while traveling between paired rollers 14 and 16. Veneer on leaving the dryer housing travels between paired rollers 18, 20.

Veneer on traveling through the housing is carried on power-driven rolls including rolls 22, 22A, 22B, and 22C. These extend transversely of the housing, and generally parallel rolls, such as rolls 14, 16, carrying the veneer into the dryer housing. Rolls 22 are laterally spaced from each other, have upper surfaces lying generally in a horizontal plane, and define a path of travel for veneer, as exemplified by the veneer shown at 24, through the housing.

Figure 3:
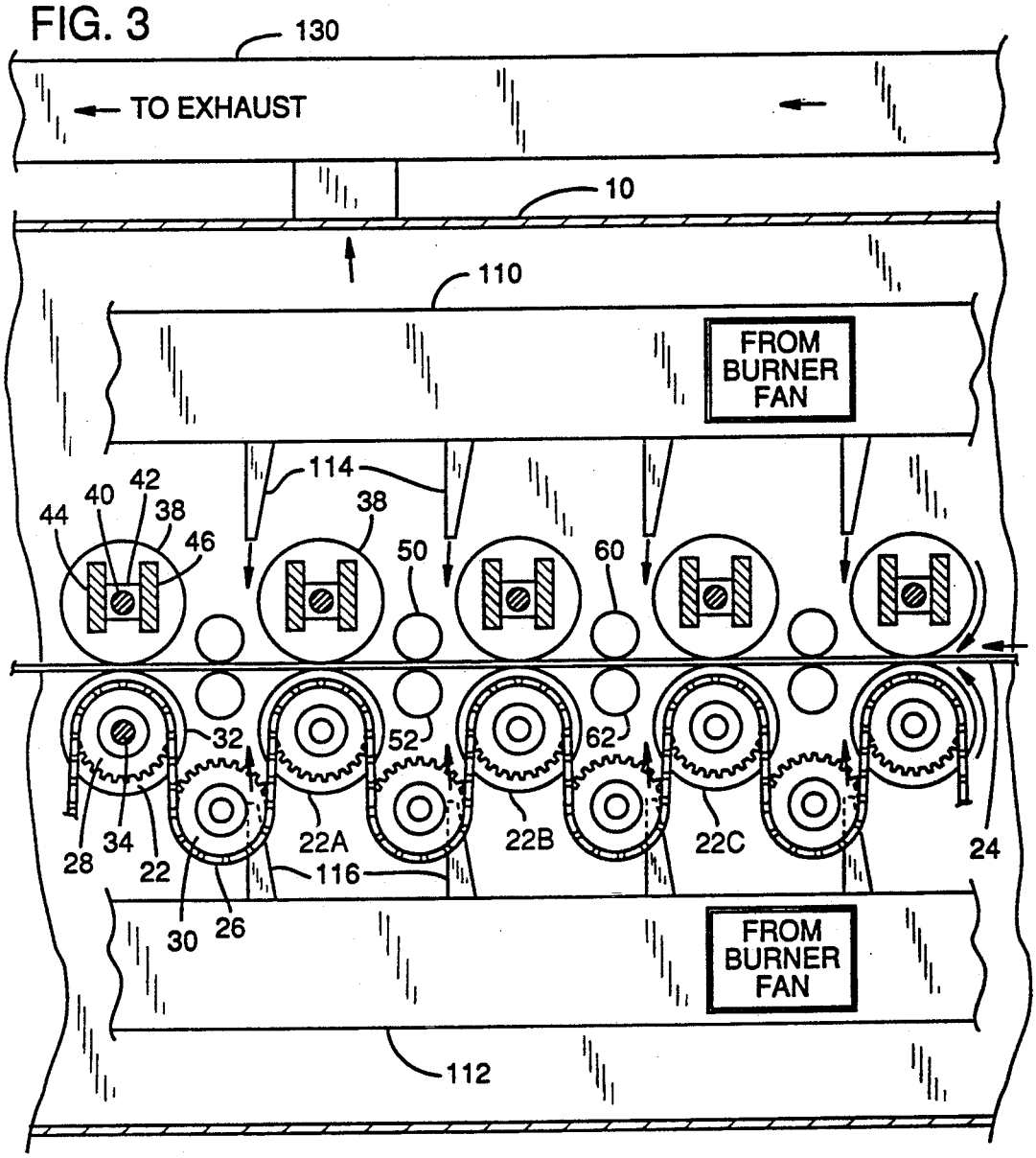
FIG. 3 is an enlarged, cross-sectional view.

The rolls are driven, as by the drive chain shown at 26 in FIG. 3. Such is suitably trained over sprockets, exemplified by sprocket 28, joined to the rolls to rotate with the rolls, and additional sprockets, such as the idler sprocket shown at 30. Powering the chain is the usual motor (not shown).

The conveyor rolls have aluminum surfaces 32. This has been found advantageous, in that it inhibits any tendency for the veneer being processed to be stained on travelling through the dryer. An aluminum surface in the conveyor rolls (and in the pressure-applying rolls to be discussed) may be produced by preparing a roll from a segment of aluminum tubing, with the outer surface of this tubing forming the periphery of the roll. A shaft may extend axially along the center of the tubing, and sleeves of dielectric material distributed along the length of the shaft may be interposed between and support the tubing on the shaft. In a construction where the tubing and shaft are to rotate as one, the tubing and shaft are interconnected whereby with rotation of the shaft the tube also rotates. With an idler-roll type of construction, the dielectric material may rotatably support the tubing on the shaft, with the tubing and the shaft then being relatively rotatable.

In the dryer, a suitable rotatable mounting for each shaft corresponding to shaft 34 in a conveyor roll may be provided, mounting the shafts on the usual frame of the dryer.

It has been found in operation of the dryer that as a result of the heat and drying action produced, there may be a tendency for veneers of certain types of woods to curl or otherwise deform from a generally flat condition. To inhibit this deformation, an ironing action is provided in the dryer which continually subjects the veneer travelling through the dryer to a flattening action.

Specifically, provided above each of the conveyor rolls, and generally parallelling the conveyor roll which is underneath it, is a pressure-applying roll, such rolls having been given the numeral 38. These rolls also are aluminum-surfaced. The aluminum surfacing of each roll is relatively rotatable with respect to a shaft 40 extending through the center of the roll. This shaft has its ends supported in blocks 42, and each block is mounted for up and down sliding movement between a pair of opposed tracks 44, 46. With the construction described, gravity functions yieldably to bias each pressure-applying roll downwardly against the conveyor roll therebeneath. Veneer passes through the nip established between a pressure-applying roll and a conveyor roll, and the veneer tends to be flattened or ironed as it passes through this nip.

In the dryer of the invention, a pair of elongate rod electrodes, with axes generally parallelling each other and also parallelling the axes of the conveyor and pressure-applying rolls, is provided between adjacent pairs of conveyor rolls, so that these pairs or sets of electrodes alternate with the conveyor rolls in a direction extending along the length of the dryer. Exemplary of such electrodes are electrodes 50, 52 making up the pair located between conveyor rolls 22A, 22B, and electrodes 60, 62 located between conveyor rolls 22B, 22C.

Veneer travelling through the dryer travels through the space provided between each of the electrodes in a pair of electrodes.

Figure 4:
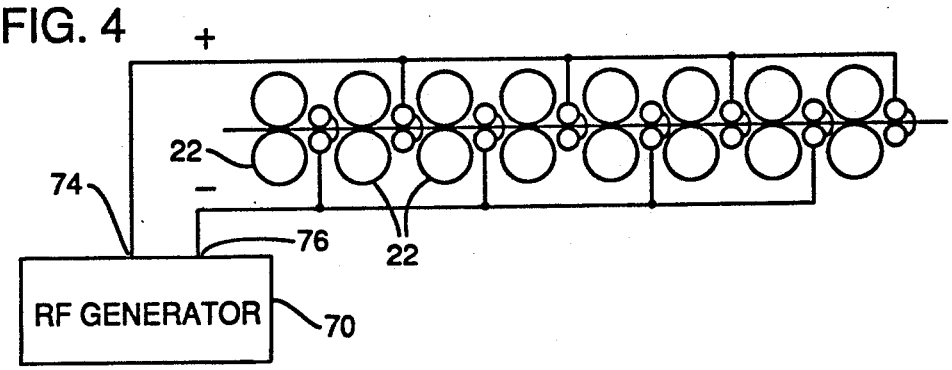
FIG. 4 is a schematic showing the connection of an R.F. generator.

The electrodes are provided with radio-frequency energy, as through using the system illustrated in FIG. 4. More specifically, illustrated at 70 is a radio-frequency generator. The generator has a pair of terminals 74, 76 which, during operation of the generator, are energized with opposite polarity signals. The electrodes of each pair of electrodes are connected to each other. Sets or pairs of electrodes connected to one of the terminals of the R.F. generator alternate with sets or pairs of electrodes connected to the other terminal of the R.F. generator. In this way, the radio-frequency generator is connected across successive pairs of electrodes through which the veneers travels.

The radio-frequency generator operates at any of the usual frequency permitted for dielectric heating. By way of example, frequencies between 3 MHz and 27 MHz have been employed.

Also producing drying of the veneer in conjunction with the radio-frequency energy are flows of moderately heated air which move across the surfaces of the veneer and which are effective to remove water collecting on these surfaces.

Further explaining, hot air heaters such as the natural gas burners shown at 100, 102 produce, when operated, flows of warm air which pass downwardly into the dryer through ducts, such as the ducts designated at 106, 108. These ducts in turn connect with hot air ducts 110, 112, extending longitudinally within the dryer (see FIG. 3). Warm air flows outwardly from these ducts, to be expelled generally in the direction of the faces of the veneer travelling through the dryer, via the nozzles shown at 114, 116.

Additionally operating to circulate warm air within the dryer are circulation fans, such as those shown at 120, 122.

A certain amount of air laden with moisture is expelled from the dryer through duct 126, which connects at spaced points with the interior of the dryer. Movement of expelled air through this duct is produced by operation of exhaust fan 130.

Describing a typical dryer and its operation, the veneer process typically might have a thickness of 1/10 inch and a dimension in a direction extending transversely of veneer travel of, for example, four to five feet. Conveyor rolls and pressure applying rolls of three and three-quarter inch diameter might be employed. The temperature of the warm air used to produce removal of surface moisture, typically might range from 250 to 350 degrees F.

Utilizing the dryer radio-frequency energy when applied to the veneer functions to drive retained moisture to the veneer surfaces. Once this moisture collects on the surface, the streams of heated air evaporate the moisture, and with the air expelled from the dryer, the air removes such moisture from the drying chamber.

With the dryer, the drying time to produce a given moisture condition might be within the range of ½ to ⅓ the drying time of conventional dryers. This, of course, means that for a given degree of drying, space requirements are reduced.

Veneers with more consistent moisture contents are produced. Heat losses that result from the use of high temperatures ar also reduced.

While a particular embodiment of the invention has been described, it should be obvious that modifications and variations are possible without departing from the invention.

It is claimed and desired to secure by letters patent:

1. A continuous radio-frequency veneer dryer comprising:

a dryer housing, multiple pairs of rolls within the housing defining a path of travel for veneer through the dryer, the pairs being spaced at intervals along said path of travel and the rolls of each pair extending transversely of the path of travel and including a lower conveyor roll and an upper pressure roll with the conveyor and pressure rolls engaging bottom and top faces of veneer being transported, plural elongate electrodes distributed at spaced intervals along said path of travel within said housing and extending transversely of said path of travel, a radio-frequency generating means having a pair of terminals energized with opposite polarity signals and conducting means connecting one of said pair of terminals to certain electrodes and the other of said pair of terminals to other of said electrodes so that electrodes of opposite polarity follow one another along said path of travel, and means for circulating heated air against opposite faces of veneer transported by said multiple pairs of rolls.

2. The radio-frequency dryer of claim 1, wherein a pressure roll is yieldably biased downwardly toward the conveyor roll therebeneath.

3. The dryer of claim 2, wherein the conveyor and pressure rolls are aluminum-surfaced, and which includes non-conductive means mounting the conveyor and pressure rolls in the dryer housing.

4. The dryer of claim 1, wherein the means for circulating air comprises plural air nozzles directing heated air against faces of veneers.

5. A continuous radio-frequency veneer dryer comprising:

a dryer housing, a series of conveyor rolls mounted at spaced intervals within the housing and defining a path of travel for veneer through the dryer, plural sets of rod electrodes, said sets of electrodes alternating with said conveyor rolls along the length of the dryer, each set of electrodes comprising an upper and a lower electrode disposed on opposite sides, respectively, of the path of travel of veneer, a radio-frequency generating means having a pair of terminals energized with opposite polarity signals, and conductor means connecting one of said pair of terminals to some of said sets of rod electrodes and the other of said pair of terminals to other of said sets of rod electrodes and the sets of electrodes connected to said one terminal alternating with sets of rod electrodes connected to said other terminal extending in the direction of travel of veneer through the dryer.

6. The radio-frequency dryer of claim 5, wherein a pressure roll is provided disposed above and opposite and parallelling selected ones of said conveyor rolls, and the pressure roll is yieldably biased downwardly toward the conveyor roll therebeneath.

7. The dryer of claim 6, wherein the conveyor and pressure rolls are aluminum-surfaced, and which further includes non-conductive means mounting the conveyor and pressure rolls in the dryer.

8. The dryer of claim 5, which further comprises means for circulating air against faces of veneer transported by the conveyor rolls, and wherein the means for circulating air comprises plural air nozzles directing heated air against faces of the veneers.

* * * * *